United States Patent [19]

Toshimitsu et al.

[11] 4,330,112

[45] May 18, 1982

[54] APPARATUS FOR COOLING A STEEL STRIP IN A CONTINUOUS ANNEALING LINE

[75] Inventors: Tohoru Toshimitsu; Norichika Nagira; Kenji Ueda, all of Kitakyusyushi, Japan

[73] Assignees: Nippon Steel Corporation, Tokyo; Nittetsu Plant Designing Corporation, Kitakyusyushi, both of Japan

[21] Appl. No.: 107,622

[22] Filed: Dec. 27, 1979

[30] Foreign Application Priority Data

Dec. 29, 1978 [JP] Japan ..... 53-162813

[51] Int. Cl.[3] ..... C21D 1/64

[52] U.S. Cl. ..... 266/115; 266/110; 266/112; 266/113

[58] Field of Search ..... 266/115, 113, 112, 110; 148/156

[56] References Cited

U.S. PATENT DOCUMENTS 4,052,235 10/1977 Nakaoka et al. ..... 148/156

*Primary Examiner*—R. Dean

*Attorney, Agent, or Firm*—Wenderoth, Lind & Ponack

[57] ABSTRACT

Method and apparatus for cooling a steel strip in a continuous annealing line, which has a first cooling step in which the steel strip immediately after an overageing treatment is cooled from the overageing temperature to a temperature in the range of from about 95° C. to 60° C., a temperature which prevents a surface oxidation but allows self-drying of the strip, in a protective atmosphere using a liquid coolant; and a second cooling step in which the steel strip is cooled to a temperature suitable for a subsequent temper rolling using liquid coolant at a temperature no higher than 40° C.

9 Claims, 4 Drawing Figures

APPARATUS FOR COOLING A STEEL STRIP IN A CONTINUOUS ANNEALING LINE

BACKGROUND OF THE INVENTION

1. Field of the Invention

The present invention relates to a method and an apparatus for cooling a steel strip in a continuous annealing line.

2. Description of the Prior Art

In recent years, various efforts have been made to increase productivity and save man power by providing a temper rolling mill within a continuous annealing line. These efforts have, however, met with difficulties since a long period of time is required for cooling the steel strip after the overageing treatment to a temperature (about 40° C.) at which the tempering treatment can be carried out and this in turn means that the annealing line must be made excessively long.

In order to overcome this problem, attempts have been made to forcedly cool the steel strip by blowing a low-temperature gas thereon but these efforts have not resulted in as great a shortening of the annealing line as had been hoped for.

On the other hand, it has been proposed to cool the strip from the overageing temperature to temperatures below 80° C. to 100° C. by first cooling the strip in the furnace and then water cooling the strip to a temperature at which temper rolling can be carried out. This method also has the disadvantage that a considerably long period of time is required for cooling from the overageing temperature to below 80° C. to 100° C.

SUMMARY OF THE INVENTION

Therefore, the object of the present invention is to provide a method and apparatus for cooling a steel strip in a continuous annealing line, in which the steel strip is cooled by a two step liquid cooling system from the overageing temperature to a temperature at which temper rolling is possible so as to eliminate the aforementioned difficulties and disadvantages of the prior art.

It is possible to shorten the cooling section following the overageing zone in the continuous annealing line by rapidly cooling the strip immediately after the overageing treatment to a temperature at which temper rolling is possible by single-step liquid cooling, but in order to rapidly cool the steel strip from a temperature of about 300° C. to about 40° C. by single-step cooling, it is necessary to employ costly, large-capacity refrigeration equipment for preparing a large amount of cooling liquid. This, of course, is a great disadvantage with respect to capital outlay.

Further, a steel strip cooled to a temperature for temper rolling by single-step cooling must thereafter be dried in a high-temperature drying step. This necessitates reheating of the strip which has been once cooled to the temper rolling temperature and nullifies the significance of the previous single-step cooling step. On the other hand, it is, in practice, impossible to use low-temperature drying to dry the strip leaving the cooling section at a temperature no higher than 40° C. before it is supplied to the looper. Thus, there is no way to avoid the necessity of supplying the strip to the looper in wetted a wet condition. This causes the so-called walk phenomenon in the looper.

Therefore, according to the present invention, the steel strip immediately after the overageing treatment is cooled to a temperature at which tempering is possible by a two-step liquid cooling procedure so as to eliminate the various difficulties described above.

More specifically, the method for cooling a steel strip in a continuous annealing line according to the present invention comprises a first cooling step in which the steel strip immediately after the overageing treatment is cooled from the overageing temperature to a temperature in the range of from about 95° C. to 60° C., namely a temperature which prevents surface oxidation but allows self-drying of the strip, in a protective atmosphere by using a liquid coolant, and a second cooling step in which the steel strip is cooled to a temperature suitable for subsequent temper rolling using liquid coolant at a temperature not higher than 40° C.

According to a preferred embodiment of the present invention, the temper rolling liquid is used as the liquid coolant in the second cooling step.

The apparatus according to the invention for cooling a steel strip coming from a continuous annealing line according to the present invention a continuous annealing system including a heating zone, a soaking zone, a primary cooling zone and an overageing zone, comprises a first-step cooling device with means for preventing oxidation of the steel strip; a looper; a second-step cooling device; and a temper rolling mill; said first step cooling device comprising a first cooling medium spraying device and a first cooling medium immersion tank in which the cooling medium is maintained at a constant temperature to be circulated to the first cooling medium spraying device; said second step cooling device comprising a second cooling medium spraying device and a second cooling medium immersion tank from which the cooling medium is taken out and cooled to a constant prescribed temperature by cold water, brine or coolant supplied from a refrigerator and is circulated to the second cooling medium spraying device.

PREFERRED EMBODIMENTS OF THE INVENTION

The present invention will be better understood from the following description of preferred embodiments.

Figure 1:
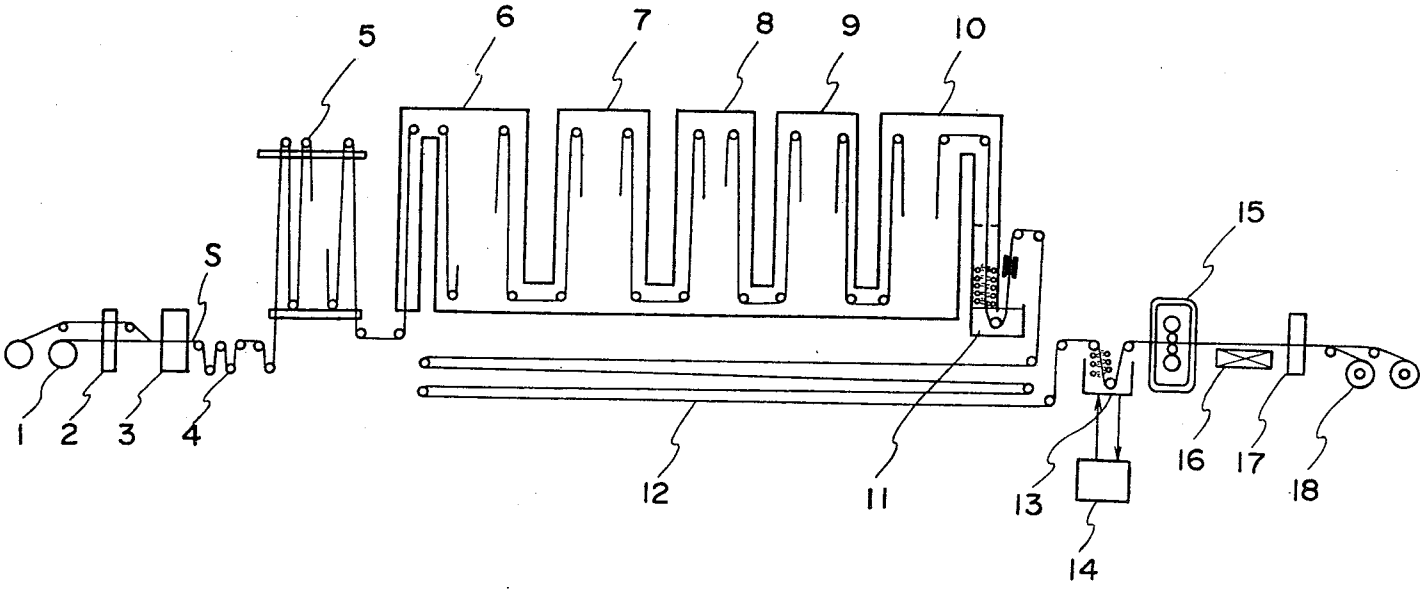
FIG. 1 is a schematic view of the continuous annealing line including the cooling apparatus according to the present invention.

FIG. 1 shows a continuous annealing line including cooling apparatus for carrying out the method of the present invention. The annealing line has a pay-off reel 1 followed by a double cut shear 2, a welder 3, an electric cleaning section 4 and a strand looper 5. From the looper 5 strip steel being annealed is fed through a non-oxidizing furnace or a radiant tube furnace 6, a soaking zone 7, a primary cooling zone 8, a primary overageing zone 9, and a secondary overageing zone 10. From zone 10 the steel is fed to a first-step cooling device 11, a loop car 12, a second-step cooling device 13, a heat exchanger 14, a temper rolling mill 15, across an inspection table 16 and to a coiling reel on which it is coiled.

In the annealing line shown in this figure, the steel strip is, immediately after the overageing treatment, cooled in a two-step method from the overageing temperature to a temperature at which temper rolling can be conducted by means of the first-step liquid cooling device 11 and the second-step liquid cooling device 13, and is then passed through the temper rolling mill 15 to be tempered.

Figure 2:
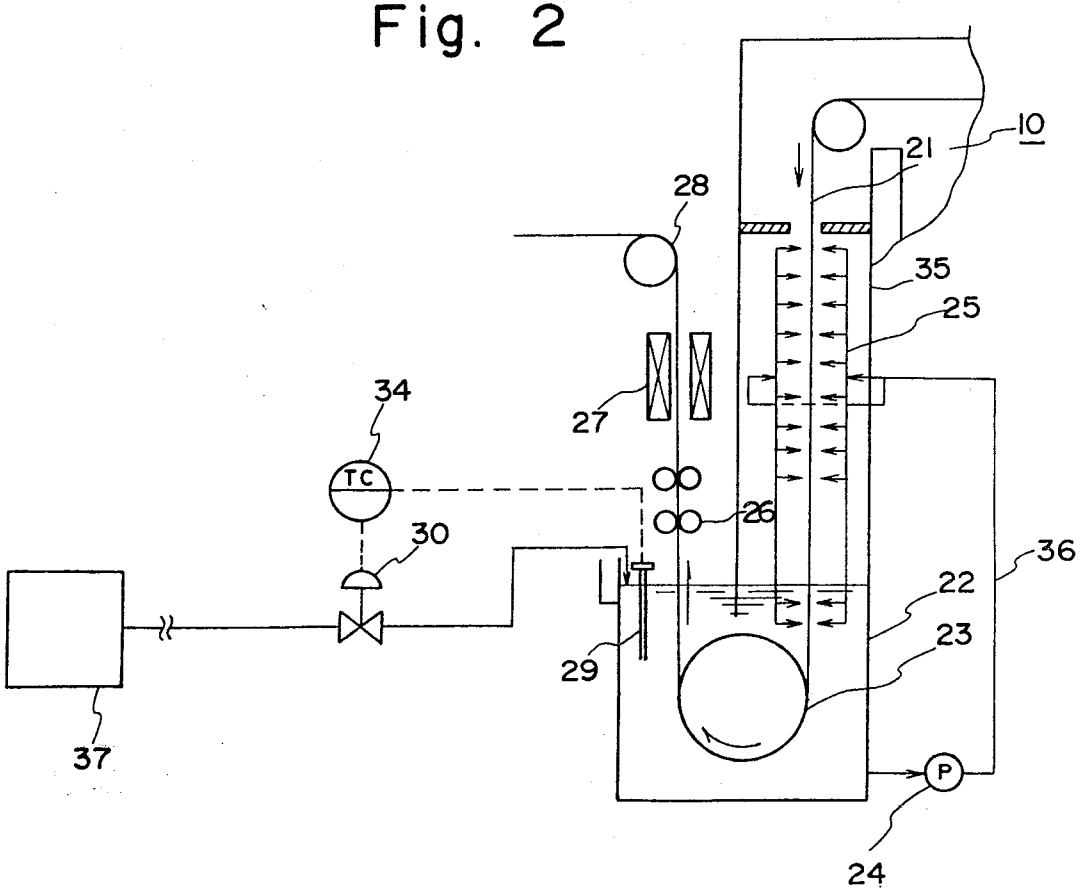
FIG. 2 is a schematic view of the first step cooling device according to the present invention.

More specifically, in the first-step cooling device which is shown in more detail in FIG. 2, the steel strip is cooled from the overageing temperature to a temperature between about 95° C. and 60° C., that is to a temperature which prevents surface oxidation but allows self-drying of the strip, in a protective atmosphere.

As shown in FIG. 2, a vertical passage 35 extends from the secondary overageing zone through the cooling zone. A first cooling medium spraying device 35 is provided in the vertical passage 35 for spraying a cooling medium, for example water. An immersion tank 22 containing the first.

In the vertical passage 35, a seal mechanism is provided above the spraying device 25, for example, in order to prevent surface oxidation of the steel strip when the strip is cooled by the cooling medium from the spraying device 25 while the strip is passed through the passage 35, and the lower end of the vertical passage 35 is positioned below the liquid level in the immersion tank 22 so as to keep the vertical passage shut off from the outside atmosphere, and, further, a protective atmosphere, for example, the atmosphere from the overageing furnace, is introduced into the vertical passage.

A thermometer 29 for measuring the temperature of the cooling medium is positioned in the immersion tank 22.

A temperature controlling device 34 is connected to the thermometer and controls a valve 30 for adjusting the amount of the liquid supplied from a cooling tower 37.

The temperature of the cooling medium in the immersion tank 22 is measured by the thermometer 29, and the supply of the cooling liquid from the cooling tower is controlled by the valve 30 so as to maintain the temperature of the liquid in the immersion tank 22 constant at a predetermined desired temperature, and the cooling liquid with the temperature thus controlled supplied to the first step cooling medium spraying device 25 through a pump 24 and conduit 36 and is sprayed onto the surface of the stell strip 21.

The steel strip 21 which has been subjected to overageing treatment in the overageing zone 10 is cooled to a temperature between about 300° C. and 100° C. by the cooling medium, which is preferably kept at about 80° C. and which is sprayed by the first step cooling medium spraying device 25 while the strip is passing through the vertical passage 35, and then the strip is immersed in the cooling medium in the immersion tank 22 and cooled to about 90° C. Upon leaving the immersion tank 22, the steel strip 21 passes through double wringer rolls 26 to a dryer 27 where it is completely dried, and then over the deflector roll 28 and through the loop car 12, after which the strip is introduced into the second-step liquid cooling device 13 (FIG. 1).

In the above-described first-step cooling device, spray cooling is employed first for the purpose of mechanically removing the boiling film which is produced on the surface of a high temperature steel strip when it is brought into contact with a cooling medium. In addition, spray cooling makes it possible to freely vary the cooling pattern in the width direction as well as in the running direction of the steel strip, so that it is possible to maintain the normal profile of the steel strip and also to improve the efficiency of the production line.

Following spray cooling by the first cooling medium spraying device 25, the steel strip which has been cooled from the overageing temperature to about 100° C. is introduced into the large-capacity immersion tank 22 containing the first cooling medium where the strip is immersed and cooled. This immersion has the effect of bringing the temperature of the steel strip into accord with the temperature of the cooling medium so that it is possible to maintain the steel strip at a constant temperature (about 90° C.) irrespective of the amount of the strip passed (ton/hour). The temperature of the steel strip is maintained at about 90° C. for the reason that at this temperature the self-drying of steel strip can be easily and rapidly effected without the occurrence of oxidation of its surface.

In this connection, it is preferable to use a process computer so as to vary the amount of spray in correspondence to the amount of the steel strip being passed and change the spray pattern in correspondence to the size of the steel strip. Temperature control of the cooling medium in the immersion tank 22 is conducted by measuring the bath temperature of the immersion tank 22 and feeding back the measured value to control the amount of the constant-temperature cooling medium such as water, supplied from the cooling tower 37.

Meanwhile, the overflow from immersion tanks 22, which has a temperature of about 90° C., is sent to an electric cleaning section (not shown) for utilization of its waste heat and cleaning and then to the cooling tower 37. This overflow system is also advantageous for removing the scum formed by carbon etc. brought in from the overageing zone.

The steel strip which has been cooled to about 90° C. by the first-step cooling device is passed through the looper to the second-step cooling device where the second-step cooling of the strip is performed.

The second step cooling will be described in detail referring to FIG. 3.

Figure 3:
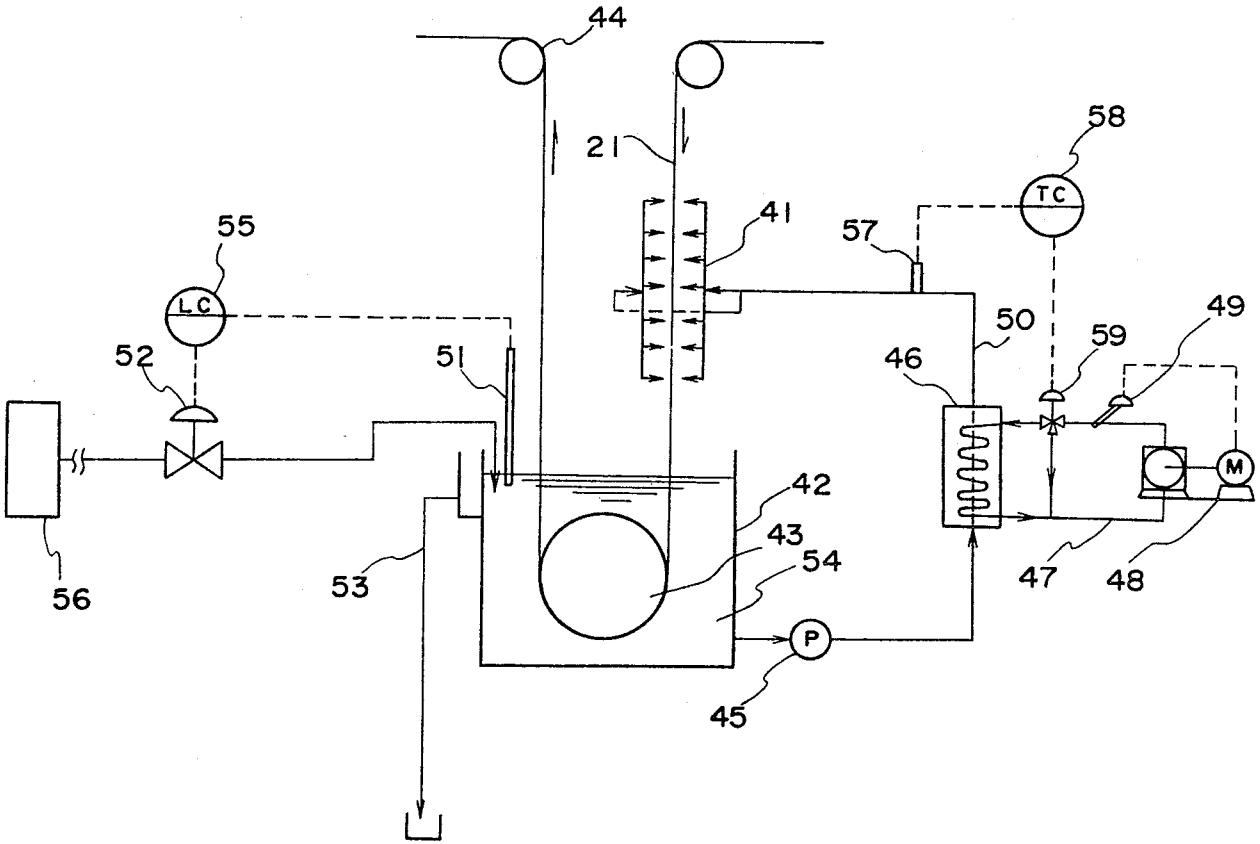
FIG. 3 is a schematic view of the second step cooling device according to the present invention.

In the second step cooling devices shown in FIG. 3, there is provided a second cooling medium spraying device 41, an immersion tank 42 containing the second cooling medium 54, a sink roll 43 in the tank 42 and a deflector roll 44. A second cooling medium spraying pump 45 pumps the second cooling medium through a conduit 50 for supplying cooling medium to the header of the spray device 41. A heat exchanger 46 is provided along the conduit 50 and is supplied with cooling medium through conduit 47. A refrigerating device 48 is provided in conduit 47. A thermometer 49 is provided in conduit 47 for sensing the temperature of the cooling medium and is connected with the motor M of the refrigerating device 48. A three-way valve 59 is connected in the conduit 47 for bypassing the cooling medium and is controlled by a temperature controlling device 58 which in turn is connected to a thermometer 57 in the conduit 50 for the second cooling medium.

The second cooling medium 54 contained in the immersion tank 42 is supplied to the heat exchanger 46 by the spray pump 45 through the heat exchanger 46, heat exchange is effected between the second cooling medium and a cooling medium such as cold water or brine which has been cooled to a constant temperature by the refrigerating means 48 and is circulated fed through the heat exchanger via the conduit 47. Thus the second cooling medium is cooled to a constant temperature and sprayed onto the surface of the steel strip 21 from the second cooling medium spraying through the conduit 50.

The steel strip 21 which has been cooled to about 90° C. by the first-step cooling device is cooled by the above spraying, and then is immersed in the immersion tank 42 to be cooled to a predetermined temperature, preferably about 40° C. The steel strip thus cooled is fed from the immersion tank 42 and is introduced to the temper rolling step to after passing over the deflector roll 44.

In the second-step liquid cooling device the reason for first conducting the cooling by the spraying of cooling medium from the second cooling medium spraying device 41 is that the heat transfer coefficient ($\alpha$) is large so that the cooling equipment may be of small size and low cost. Also when temper rolling liquid is used as the cooling medium, a satisfactory wetness of the strip surface can be assured by the spray cooling. In addition to this, the spray pattern can be freely changed in correspondence to the size of the strip so that the production efficiency of the equipment can be raised. As for the temper rolling liquid which can be used as the cooling medium, an aqueous solution of $Na_2NO_3$, organic amines, emulsions of oils and fats and mineral oils etc. can be used.

In this way, the steel strip which has been immersed in the cooling medium 54 in the immersion tank 42 and cooled to about 40° C. leaves from the immersion tank 42 and, without being dried, is introduced to the temper rolling mill 15 (FIG. 1) after passing the deflector roll 44.

In FIG. 3, a detector 51 is provided for detecting the level of the cooling medium in the immersion tank 42; and it is connected to a level adjusting meter 55 which in turn controls a valve for adjusting the amount of cooling medium to be supplied; from a cooling medium tank 56. An overflow duct 53 is also provided for tank 42.

These members in combination function in such a manner that the level of the cooling medium in the immersion tank 42 is detected by the detector 51 and a predetermined amount of the cooling medium is maintained in the tank by the adjustment of the adjustment valve 52, so that the immersion time of the strip in the tank is maintained constant.

One embodiment of the present invention in which the steel strip coming out of the second-step liquid cooling device is passed to the temper rolling mill through rolls of non-woven fabric will be described with reference to FIG. 4.

Figure 4:
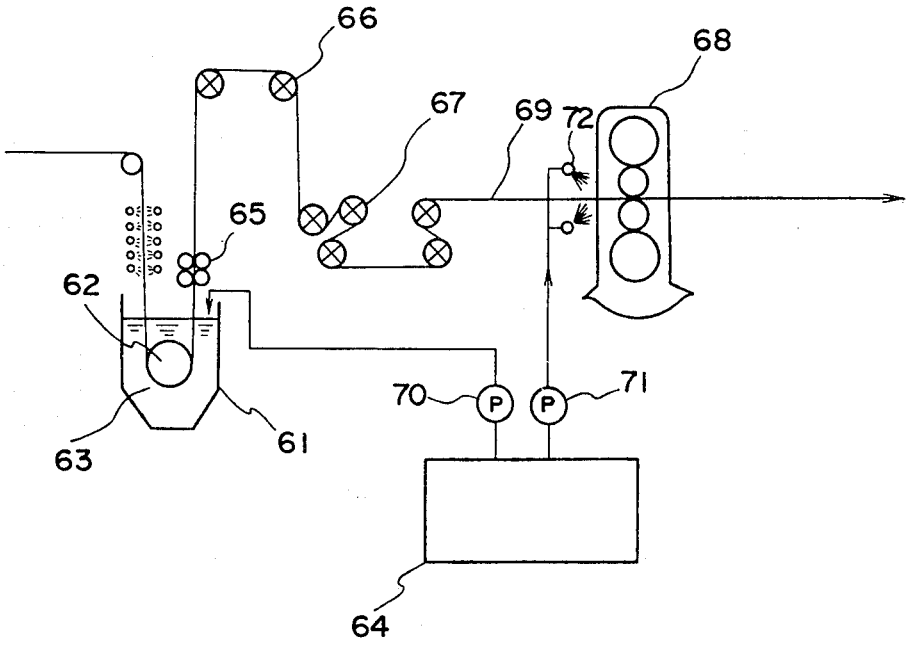
FIG. 4 is a schematic view of a modification of the second step cooling device according to the present invention in combination with a temper rolling mill.

In the embodiment shown in FIG. 4, there is provided an immersion tank 61 containing a second cooling medium 63, e.g. a temper rolling liquid, and a sink-roll 62. Double wringer rolls 65 are provided above the tank 61 and from then the strip 69 is supplied to a steering roll 66 of non-woven fabric, bridle rolls 67 of non-woven fabric and then to the temper rolling mill 68. A storage tank 64 is provided for the temper rolling liquid, and a pump 70 supplies the temper rolling oil to the immersion tank 61, and a pump 71 supplies the temper rolling liquid to a spray 72 in the temper rolling mill.

In this embodiment, the steering roll 66 and the bridle rolls 67 are made of non-woven fabric for the purpose of maintaining the required friction coefficient between the strip and the rolls because the strip is cooled by being immersed in and sprayed by the temper rolling liquid and thus the strip is coated with the temper rolling liquid in the second-step cooling, and the strip thus coated is passed through the temper rolling mill in a wetted condition which readily causes the walking phenomenon.

The steel strip 69 is sprayed again slightly with the temper rolling liquid at the inlet of the temper rolling mill 68 and temper rolled.

The present invention is not limited to the above described embodiments, but various modifications may be made within the scope of the present invention.

What is claimed is:

1. An apparatus for cooling a steel strip being delivered from the overageing section of a continuous annealing line, said apparatus comprising:

a first step cooling device having a first cooling medium spraying device, a first cooling medium immersion tank below said first cooling medium spraying device, means operatively associated with said first cooling medium immersion tank for maintaining the first cooling medium at a constant temperature in the range of 95°-65° C. whereby self drying can take place, means connected between said first cooling medium immersion tank and said first cooling spraying device for circulating the first cooling medium thereto, and means for passing the steel strip past said first cooling medium spraying device and through said first cooling medium immersion tank;

a looper for receiving steel strip from said first step cooling device;

a second step cooling device to which said looper delivers steel strip, said second step cooling device having a second cooling medium spraying device, a second cooling medium immersion tank below said second cooling medium spraying device, means connected to said first second cooling medium immersion tank for circulating the second cooling medium to said second cooling medium spraying device, refrigeration means for cooling the circulated second cooling medium to a temperature at least as low as 40° C., and means for passing the steel strip past said second cooling medium spraying device and through said second cooling medium immersion tank.

2. An apparatus as claimed in claim 1 in which said first step cooling device further has a dryer at the outlet end thereof and through which said means for passing the steel strip passes the cooled steel strip for completion of self-drying of the strip.

3. An apparatus for cooling a steel strip being delivered from the overageing section of a continuous annealing line, said apparatus comprising:

a first step cooling device having a vertical passage, a first cooling liquid spraying device in said passage, a first cooling liquid immersion tank at the lower end of said passage and in which the lower end of said vertical passage is positioned below the normal level of the first cooling liquid in said immersion tank, the upper end of said vertical passage having means for preventing entry of the atmosphere around the vertical passage into the vertical passage, means operatively associated with said first cooling liquid immersion tank for maintaining the first cooling liquid at a constant temperature in the range of 95°-65° C. whereby self-drying can take place, means connected between said first cooling liquid immersion tank and said first cooling liquid spraying device for circulating the first cooling liquid thereto, and means for passing the steel strip through said vertical passage and through said first cooling liquid immersion tank;

a looper for receiving steel strip from said first step cooling device;

a second step cooling device to which said looper delivers steel strip, said second step cooling device having a second cooling liquid spraying device, a second cooling liquid immersion tank below said second cooling liquid spraying device, means connected to said second cooling liquid immersion tank for circulating the second cooling liquid immersion tank for circulating the second cooling liquid to said second cooling liquid spraying device, refrigeration means for cooling the circulated second cooling liquid to a temperature at least as low as 40° C., and means for passing the steel strip past said second cooling liquid spraying device and through said second cooling liquid immersion tank.

4. An apparatus as claimed in claim 3 in which said first step cooling device further has a dryer at the outlet end thereof and through which said means for passing the steel strip passes the cooled strip for completion of self-drying of the strip.

5. An apparatus as claimed in claim 3 in which said means in said vertical passage for preventing entry of the outside atmosphere is seal means at the upper end thereof through which the steel strip passes and which substantially seals out atmosphere from outside said vertical passage.

6. An apparatus as claimed in claim 3 in which said means in said vertical passage for preventing entry of the outside atmosphere is means connecting said vertical passage to the overageing furnace in substantially gas tight relationship, whereby substantially only the atmosphere from the overageing furnace can enter said vertical passage.

7. An apparatus as claimed in claim 3 in which said means for maintaining the first cooling liquid immersion tank at a constant temperature comprises means for supplying cooled first cooling liquid and means responsive to the temperature in said first cooling liquid immersion tank for controlling the amount of first cooling liquid supplied to said first cooling liquid immersion tank.

8. An apparatus as claimed in claim 3 in which said refrigeration means comprises a heat exchanger in said means for circulating said second cooling liquid, and means responsive to the temperature of the circulating second cooling liquid for controlling the amount of refrigerant flowing in said heat exchanger.

9. An apparatus as claimed in claim 3 in which the second cooling liquid is temper rolling liquid, and said apparatus further comprises means for supplying temper rolling liquid to said second cooling liquid immersion tank from a reservoir for supplying temper rolling liquid to a temper rolling mill to which the steel strip is fed from said second step cooling device.

* * * * *